US005577371A

United States Patent [19]

Lang et al.

[11] Patent Number: 5,577,371

[45] Date of Patent: Nov. 26, 1996

[54] APPARATUS FOR HOOPING A PACKAGE

[76] Inventors: Georg Lang, Marktheidenfelder Strasse 2, 97855, Triefenstein; Berthold Buehrle, Ringstrasse 25, 89143, Blaubeuren; Gerd Mosca, Im Muehlengrund 1, 74864, Fahrenbach, all of Germany

[21] Appl. No.: 428,727

[22] Filed: Apr. 25, 1995

[30] Foreign Application Priority Data

May 6, 1994 [DE] Germany ..... 44 16 013.5

[51] Int. Cl.[6] ..... B65B 13/04

[52] U.S. Cl. ..... 53/589; 53/582; 100/33 R; 100/30

[58] Field of Search ..... 53/589, 582; 100/25, 100/26, 29, 30, 33 R

[56] References Cited

U.S. PATENT DOCUMENTS

| | | | |
|---|---|---|---|
| 3,577,909 | 5/1971 | Takano et al. | 100/26 |
| 3,735,555 | 5/1973 | Pasic | 53/582 |
| 3,841,055 | 10/1974 | Takumi | 53/589 |
| 4,781,110 | 11/1988 | Sakaki et al. | 100/26 |
| 4,896,482 | 1/1990 | Bohl et al. | 53/589 |
| 5,078,058 | 1/1992 | Schwede et al. | 100/26 |
| 5,267,508 | 12/1993 | Yoshino | 100/26 |

FOREIGN PATENT DOCUMENTS

| | | |
|---|---|---|
| 1786028 | 12/1971 | Germany . |
| 3438177 | 4/1986 | Germany . |
| 4024149A1 | 2/1992 | Germany . |
| 4024149C2 | 2/1992 | Germany . |
| 4237787 | 6/1993 | Germany . |

*Primary Examiner*—John Sipos
*Assistant Examiner*—Gene L. Kim
*Attorney, Agent, or Firm*—Spencer & Frank

[57] ABSTRACT

An apparatus for hooping a package is described, in which the band in its end position, applied to the package and tensioned, defines a hooping plane which extends in the conveying direction. A band guide channel in the form of a plane, rectangular frame intersects the hooping plane at an acute angle in an intersection line at right angles to the conveying direction. The otherwise customary binding head has a stationary device for holding fast and joining the band loop ends and for separating the oncoming band, and a pivotable device separate therefrom for the insertion and pulling-back of the band. The pivotable device has a pivot axis substantially coinciding with the intersection line. On the insertion of the band into the band guide channel said pivotable device is situated in the frame plane and is pivoted into the hooping plane before or during the pulling-back of the band.

18 Claims, 5 Drawing Sheets

APPARATUS FOR HOOPING A PACKAGE

BACKGROUND OF THE INVENTION

The invention relates to an apparatus for hooping a package, that includes a conveyor which conveys the package in a conveying direction into a hooping position. A band is positionable into an end position in which the band is applied against the package and tensioned and forms a band loop defining a hooping plane extending in the conveying direction. A band guide channel is provided which forms a substantially rectangular frame surrounds the package when the package is in the hooping position. The band guide channel receives the band and forms the band into a loop shape. The rectangular frame defines a frame plane that intersects the hooping plane at an acute angle along an intersection line located at a right angle to the conveying direction. A band binding head is positioned adjacent to the rectangular frame. This relates to a longitudinal hooping apparatus in which the hooping plane extends in the conveying direction and a plane, frame-like band guide channel is provided, the plane of whose frame obliquely intersects the hooping plane and which has dimensions such that the package can be conveyed through it.

An apparatus of this kind is known from German Offenlegungsschrift 42 37 787, FIG. 3 The apparatus described has a conveyor in which the conveying plane is horizontal. Accordingly, two portions of the band guide channel which lie opposite one another lie at right angles to the conveying plane on two sides of the hooping plane, while the other two portions of the band guide channel pass obliquely through the hooping plane respectively above and below the conveying plane. A binding head is installed in that portion of the band guide channel which is horizontal and situated beneath the conveying plane. It could also be called a tensioning and closure head or the like. The binding head effects the insertion of the band into the band guide channel, and also the pulling-back, tensioning, joining and separation of the band. This binding head is pivotable as a complete unit about an axis which is at the same time the line of intersection of the hooping plane with the frame plane bounded by the band guide channel. The pivoting drive is so designed that the binding head is situated in the frame plane on the insertion of the band (the path of the band lies in the frame plane as it passes through the binding head), and that, after the package has reached the hooping position, the head pivots into the hooping plane. At least the last phase of the pulling-back process and possibly of the tensioning process, as well as the joining and separation of the band, take place in this position.

It has however been found that the entire binding head constitutes a relatively large inertial mass and that it is not possible to carry out the pivoting processes sufficiently quickly to enable working speeds such as are demanded at the present time to be achieved. Furthermore, a pivotable binding head entails considerable design problems. The space available beneath the conveying plane is very restricted and the movable parts and the drive are subjected to very heavy loads.

SUMMARY OF THE INVENTION

The object on which the invention is based is that of so designing a hooping machine of the generic type defined in the introduction that, while acceptable in terms of cost, it works quickly and reliably.

For a hooping machine of the generic type defined this object is achieved according to the invention by providing the band binding head with a stationary device for holding fast and joining the ends of the band to form the band loop from the loop shape and for separating a portion of the band that forms the band loop from the oncoming band. The binding head further includes a pivotable device, separate from and adjacent to the stationary device, for inserting the band into the band guide channel and for pulling back the band to place the band in the end position. The pivotable device is mounted for pivoting about a pivot axis substantially coinciding with the intersection line. The pivotable device is located in the frame plane during the insertion of the band into the band guide channel and is pivotal into the hooping plane before or during the pulling-back of the band. The basic principle consists in separating from the binding head a part which is able to pivot the band loop from the frame plane into the hooping plane. Only this separated device, with the aid of which the band is inserted and pulled back, is mounted for pivoting about a pivot axis substantially coinciding with the line of intersection of the frame plane and the hooping plane. It guides and holds the doubled band ends during the pivoting and thereby effects the slinging-around of the entire band loop. For this special function the pivotable device can be made particularly light. All other parts of the binding head which carry out different functions, such as for example holding fast and joining the ends of the band loop and separating the oncoming band, are of stationary design and therefore not critical in respect of their weight.

The hooping process proceeds in such a manner that on the insertion of the band into the band guide channel the pivotable device is situated in the frame plane and pivots over into the hooping plane after the band guide channel has been opened. The pivoting may take place before the band is pulled back, as long as the band loop is still held in the opened band guide channel by brushes or the like. On the other hand, in the event of rapid succession of the packages, the pulling-back of the band already starts during the pivoting. As soon as the band has then been separated, the partial device in question can be pivoted back again and the next band loop can be inserted while the hooped package is still being conveyed on and the next package is being brought into the hooping position.

It is proposed that the pivotable device has an insertion channel whose mouth is situated in the region of the pivot axis. From the mouth of the insertion channel the band passes over into the band guide channel, which forms the loop around the package and guides the starting portion of the band back again into the region of the insertion channel mouth. As is known per se, the starting portion then lies above the band portion which is situated in front of the mouth and which has not yet been separated.

In order to enable the doubled band portions to be moved conjointly, through the pivoting of the device, into the hooping plane, in which the components of the stationary device act on them, the two band portions must be held together so that they cannot deflect. Although the endless band portion is held on the pivotable device by the insertion channel, which is made with a closed cross-section for the starting portion guided back through the band guide channel, it is nevertheless proposed, as an important feature of the invention, that on the pivotable device an intermediate clamp device is arranged, which fixes the starting portion on the pivotable device at least until the latter has been pivoted into the hooping plane. After the band end has been clamped fast in the stationary device with a greater clamping force (usual technique), the intermediate clamp device is released again, so that the band can be pulled back unhindered and if desired be retensioned, without the starting portion being able to free itself from the clamping grip.

The intermediate clamp device proposed is advantageously one which grips the band at the edges, that is to say in the direction of the plane of the band and transversely to the longitudinal direction of the band. Because of simpler actuation, the intermediate clamp device is preferably in the form of a clamp lever.

According to a further principle of the invention another solution of the clamping problem consists in that a clamp device is provided which grips the starting portion of the band at its longitudinal sides in the position reached after passing through the band guide channel, and that at least the clamping elements of this device are mounted for pivoting about the pivot axis and are drivingly connected to the pivotable device. This amounts to a modification of the stationary clamp device known at the present time. If, for example, a sliding member and a pushrod pressing from below on said member are used as known clamp elements, each of these could be given a rotatably mounted pressure plate, at least one of the pressure plates being pivotally connected to the pivotable device, if possible via a freewheel, so that the pivotable device can be pivoted back again into the insertion position after the band has been cut off and while the clamp device is still in operation.

With regard to the constructional design of the pivotable device, it is proposed to provide, as supporting structure, a U-shaped bow whose first limb is in the form of a pivot arm having a strong bearing, while its second limb supports the portion of the insertion channel on the mouth side. This construction makes it possible for the pivotable device to engage around the stationary device, while the pivot axis passes through the stationary device as an extension of the pivot pin.

In a first embodiment of the pivotable device the latter has a feed device consisting of two or more cooperating rollers which clamp the band between them and are driven by a motor, particularly an electric motor. The rollers and the motor are fastened to the pivotable device and are pivoted together with the latter. In order further to reduce the inertial mass of the pivotable device, the motor may also be arranged as a stationary unit and be drivingly connected to the feed rollers by means of a flexible shaft. In any case, when the pivotable device has a feed unit which also conveys the band back, it is proposed to provide a flexible band guide channel between the pivotable device and a band magazine (cassette). The flexible band guide channel may be a tightly wound steel wire coil which may also have a rectangular cross-section.

Another proposal consists in that the pivotable device should not have a feed device at all, but that its insertion channel should be connected via a flexible band guide channel to a stationary feed roller arrangement. This then advantageously leads to an extremely great reduction of the weight of the pivotable device and to a correspondingly simpler and faster pivoting drive.

The stationary feed roller arrangement may also be in the form of a retensioning device which applies an increased tensile force to the band. A retensioning device of this kind is frequently provided in addition to the normal insertion and pull-back device. In certain circumstances it is possible to dispense with a flexible band guide channel when feed rollers are provided for insertion purposes on the pivotable device and feed rollers separate therefrom are provided in a stationary arrangement for pulling-back and optionally retensioning the band.

It is pointed out that the transfer of the band loop from the frame plane into the hooping plane may be assisted by band guide elements. It is proposed that in at least one guide plane which is at right angles to the hooping plane and intersects the band guide frame, and which in a vertical hooping machine may be the conveying plane, band guide elements having guide edges are provided, which form a straight slit, through which the hooping plane passes, and which at the ends of said slit are bent away in a curve at an obtuse angle in the direction of the respective frame portion passing at right angles through the guide plane. The conveyor table will thus be provided with a slit which has two bends and whose respective edges serve as guide edges.

Additionally, it is proposed that two rams movable at right angles to the first guide plane (for example the conveying plane) are provided, which press the package against the guide plane after it reaches the hooping position, and that the pressure plates of these rams should have additional guide edges congruent with the guide edges of the first guide plane. Instead of using the pressure plates of rams as the guide plane, however, the second guide plane may likewise be stationary. In the case of a horizontal hooping machine both guide planes extend vertically. They do not need to come into contact with the package.

The invention is not restricted to customary bands whose cross-section is substantially wider than thick, for example 5 mm×0.38 mm. A plastics band having these dimensions is frequently used for bundling stacks of periodicals and newspapers. The term "band" for the purposes of the invention also includes tension cords having an oval, round or other cross-section. All materials usable for the purpose should also be included.

BRIEF DESCRIPTION OF THE DRAWINGS

One exemplary embodiment is explained below with reference to the drawings, in which.

DETAILED DESCRIPTION OF THE INVENTION

Figure 1:
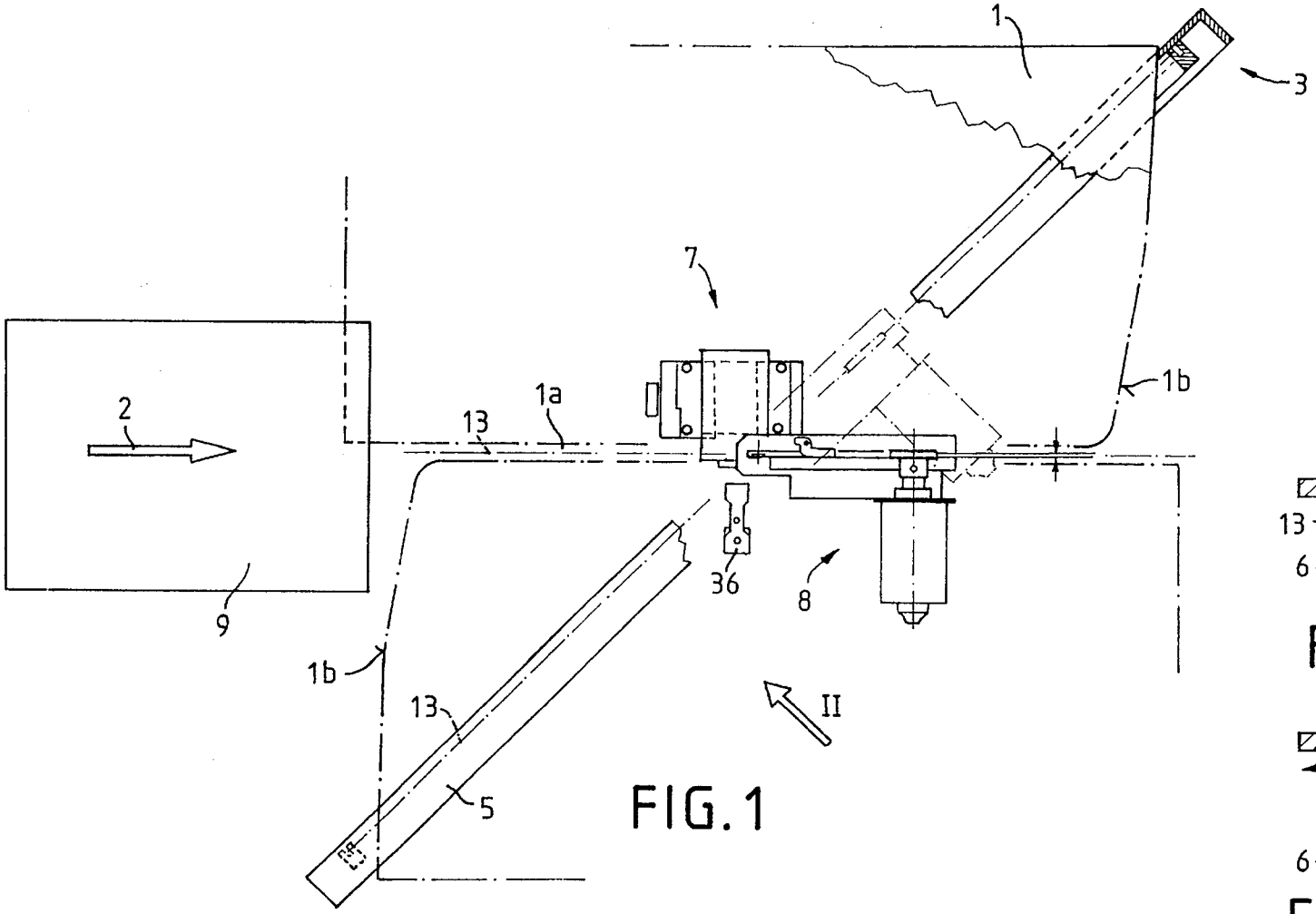
FIG. 1 shows a plan view of the band guide frame, partly broken away and shown in horizontal section on the line I—I of FIG. 2, of a hooping machine having a horizontal conveying plane, the conveying means not being shown in order to make the stationary device and the pivotable device visible.
Figure 2:
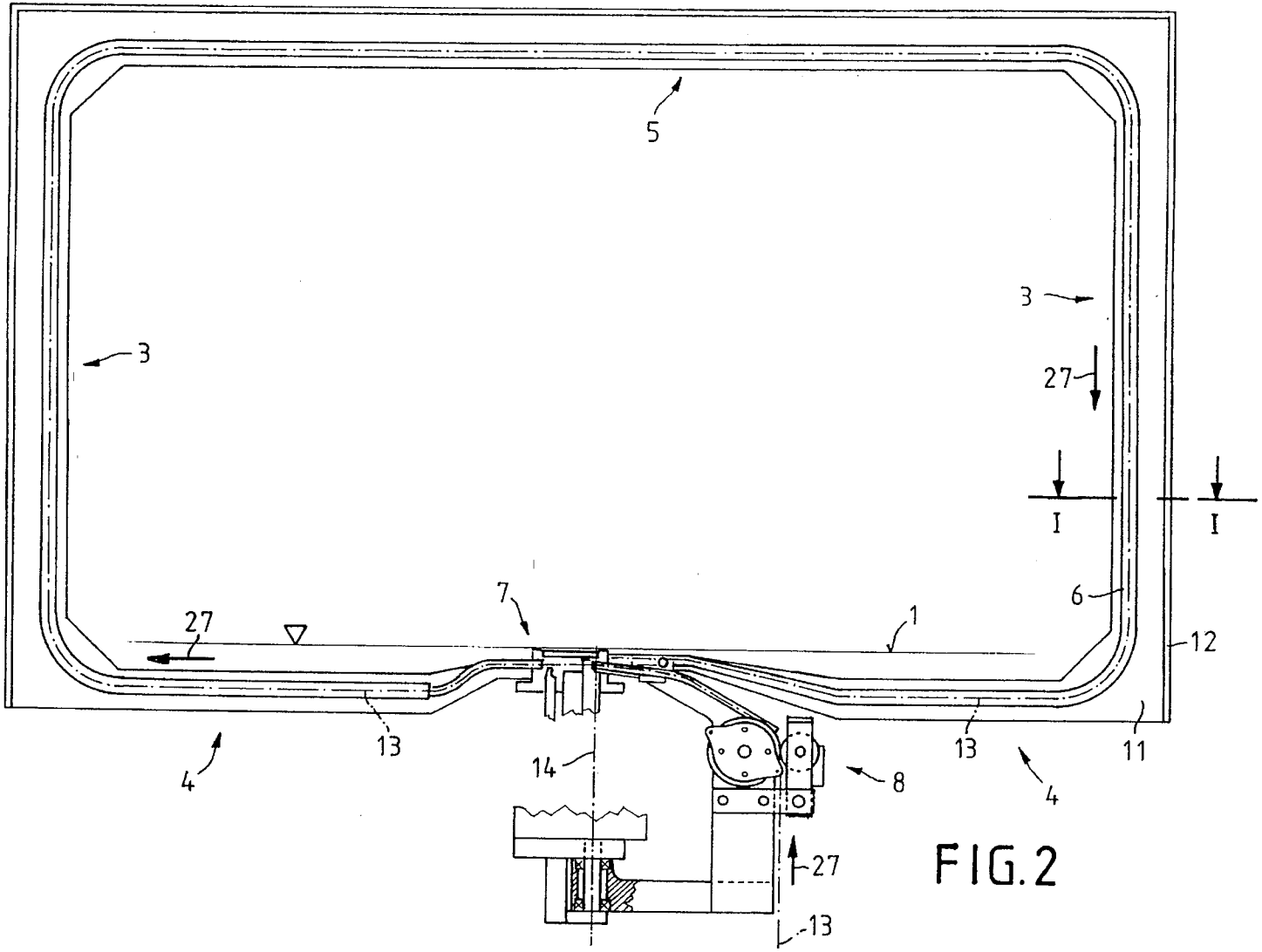
FIG. 2 shows a view of the band guide frame according to FIG. 1 in the direction of the arrow II.

In FIGS. 1 and 2 the hooping apparatus is shown full-length. The band guide frame has a plane, rectangular shape and stands vertically on the conveying plane 1 imagined as parallel to the plane of the paper, but obliquely to the conveying direction 2. Of the two frame portions 3, which pass at right angles through the conveying plane 1, one can be seen in cross-section in FIG. 1. At the bottom, the frame portions 3 merge via 90° curves into two short horizontal frame portions 4. The frame portions 4 extend toward each other under the conveying plane 1 and form a gap between their respective ends in which a stationary closure device 7 and a pivotable insertion and pull-back device 8 are arranged. At the top, the vertical frame portions 3 are connected to one another by a horizontal frame portion 5. A cuboidal package 9 arriving in the conveying direction 2 can move through under the portal formed by the frame portions 3 and 5. The length of the package 9 is not greater than the distance between the frame portions 3 in the conveying direction 2. In the center under the band guide channel the package 9 is halted. This is its hooping position.

The conveying plane 1 comprises two horizontal plates which together form a straight slit 1*a* extending in the middle in the conveying direction. At the ends of the slit 1*a* its boundary lines, the so-called guide edges 1*b*, bend away at an obtuse angle to form a curve, in the direction of the respective frame portion 3. By means of the guide edges 1*b* the band 13 is guided towards the slit 1*a* when the band loop is pulled together. When the band 13 lies against the package at the bottom, it passes through the slit 1*a*. Conveyor belts (not shown), which move on the conveying plane, have dimensions such and are so arranged that they do not cover the slit 1*a* and the other guide edges 1*b*.

In addition, two rams (not shown) are arranged on both sides of the band guide frame and move at right angles to the conveying plane 1, pressing the package against the conveying plane. The pressure plates of these rams likewise form guide edges, which extend substantially congruently with the guide edges 1*b* of the conveying plane 1. The transfer of the band loop into the hooping plane in the top region thereof, above the package, is thereby assisted.

Figure 3:
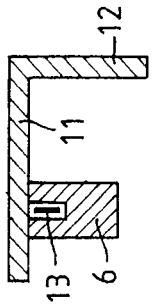
FIG. 3 shows the cross-section I—I of the band guide frame on a larger scale, in the closed position.
Figure 4:
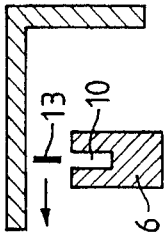
FIG. 4 shows the same cross-section as FIG. 3, with the band guide frame opened.

As shown in the cross-sections, particularly FIG. 3, the band guide frame consists of a movable enveloping frame 6 and a stationary angle frame. The latter forms a plane bearing surface 11 for the enveloping frame and for stiffening purposes has a bent-away portion 12. The enveloping frame 6 is made from a hard plastics sectional material having a rectangular cross-section and is provided with a peripheral groove 10 on its side facing the bearing surface 11. This groove surrounds the inserted band 13 on three sides. The groove 10 is covered when the enveloping frame 6 lies against the bearing surface 11. This is the closed position of the band guide frame according to FIG. 3. In a fast movement driven by pneumatic cylinders (not shown) the enveloping frame 6 is moved a little away from the bearing surface 11 into the opened position of the band guide frame as shown in FIG. 4. The band loop formed by the band 13 is thereby freed.

The pivot axis 14 of the device 8 extends in the middle of the band guide frame and at right angles to the conveying plane. As can best be seen in FIG. 7, the device has a bow-shaped design. The bottom limb of the bow forms a pivot arm 15, which is mounted by means of a sturdy bearing on a stationary pivot pin 16. An electric motor 18 and the bearing of a pressure roller 19 are fastened, with their axes horizontal, on the web 17 of the bow, said web extending vertically upwards in the example. The pressure roller 19 lies against the circumference of a drive roller 20 fastened on the motor shaft and thus presses the band 13 onto said drive roller. A proximity sensor 21 detects whether the pressure roller 19 is turning or stationary.

The top limb of the bow-shaped device 8 (FIG. 7) is formed by a projecting arm 22. It has a T-shaped supporting section consisting of a rib 23 and a flat supporting strip 24. On the latter extends a sheet metal insertion channel 25 which has a closed cross-section and whose inside cross-section permits unhindered passage of the band 13 but has no unnecessary cross-sectional play. The insertion channel 25 starts, at the point of contact of the rollers 19 and 20, in the form of an obliquely rising portion and finally merges into a portion rising at a flat angle and ending with its mouth 26 approximately at the point where the pivot axis 14 comes to the top. To be exact, in this example the axis 14 passes through the insertion channel 25 slightly before its mouth 26.

Figure 5:
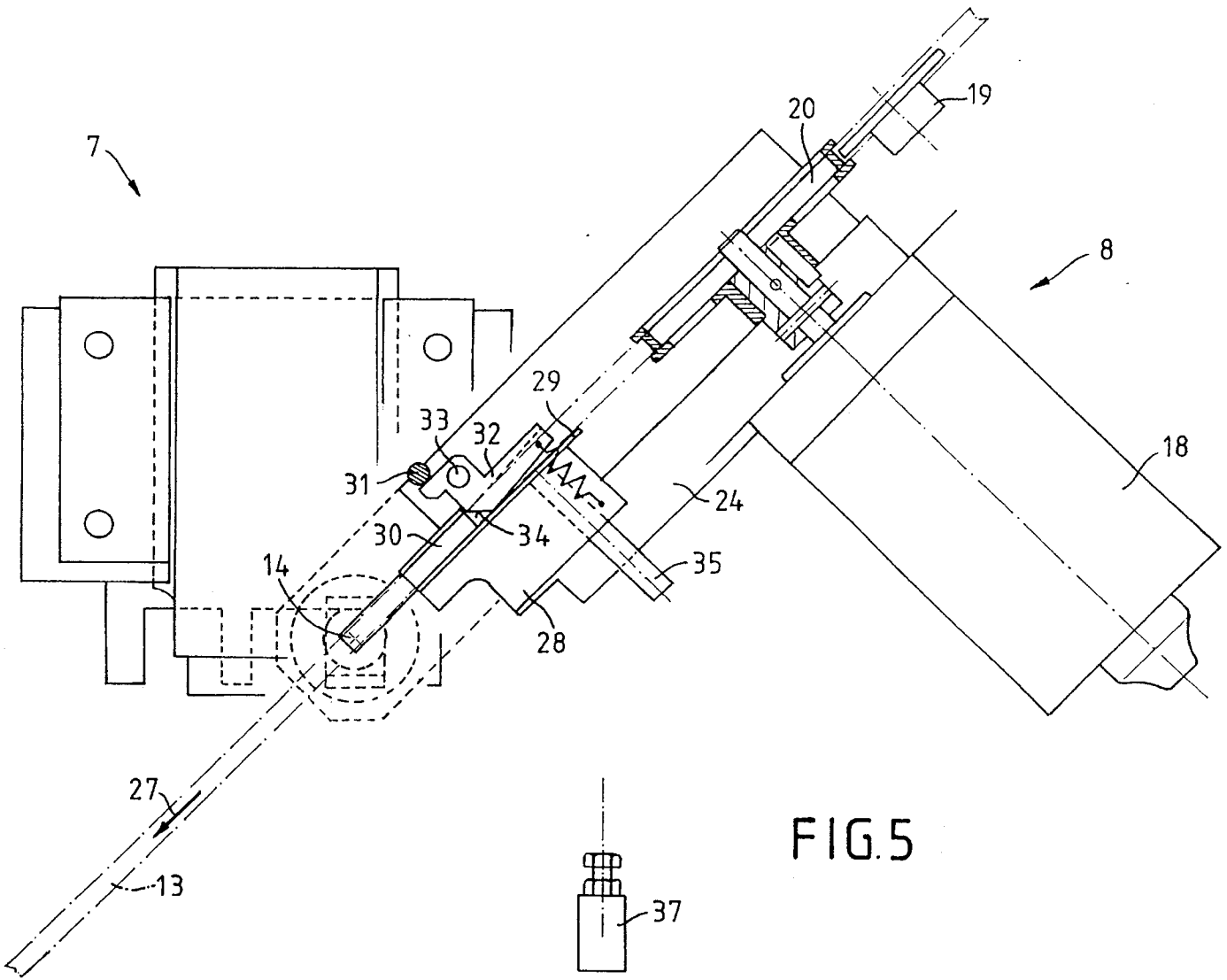
FIG. 5 shows a plan view of the devices according to Figure I on a larger scale, in the insertion position.

The illustration in FIG. 5 shows the pivotable device 8 in the insertion position. The insertion channel 25 lies in the plane of the band guide channel. The band 13, coming from below, enters the insertion channel 25 in the region of the pressure roller 19, is pushed, after passing the mouth 26, in the insertion direction 27 into that portion 4 of the band guide channel which is shown on the left in FIG. 2, rises in the first frame portion 3, and finally, in the channel of the second frame portion 4, comes back to the device 8. The beginning of the band arrives above the insertion channel 25, runs over the superstructural parts of the projecting arm 22 and the mouth 26, and, after a further short travel, actuates an electric switch (band switch—not shown) which stops the electric motor 18 used for the insertion.

The superstructural parts mentioned are a guide block 28 and a clamp lever 32 which is L-shaped in plan view. On the left side of the band 13, in relation to the insertion direction 27, the guide block 28 forms a vertical wall 29. The clamp lever 32 is pivotally mounted by means of a pivot pin 33 and on its side facing the wall 29 has a groove which is slightly narrower than the band 13. When therefore the clamp lever is pulled against the wall 29 by means of a schematically indicated tension spring, it clamps the band 13 at its edges. Adjoining the clamp lever 32 in the insertion direction a flat groove 30, which is open at the top, is formed in the guide block 28. The groove likewise guides the band laterally.

A stationary stop pin 31 cooperates with a beak on the clamp lever 32 in such a manner that in the insertion position shown in FIG. 5 the clamp lever 32 is slightly lifted off the wall 29 against the force of the spring. Consequently, and because of a widening of the groove of the clamp lever 32 at the band exit end, the effect is achieved that in this position the clamping action is suspended. When the beginning of the band 13, after its circuit in the band guide frame, now passes out of the right-hand frame portion 3 (as shown in FIG. 2), it passes through the groove of the clamp lever 32, which is in its released position, and then through the groove 30 of the guide block 28. The beginning of the band thereupon approaches, at a flat angle, the portion of band arriving beneath it.

As soon as the beginning of the band trips the previously mentioned band switch and thus stops the band drive, the band guide channel opens and the pivoting movement of the device 8, preferably driven by a pneumatic cylinder, begins immediately. On the commencement of the pivoting movement the beak of the clamp lever 32 is at once lifted off the stop pin 31, so that the spring comes into action and the band 13 is held fast on the projecting arm 22 by the clamp lever 32. It is thus possible, when the device 8 is then pivoted through 45°, for both the band portion lying in front of the mouth 26 of the insertion channel 25 and the beginning portion of the band lying floating thereabove to be conjointly pivoted about the pivot axis 14. The doubled band portions are thereby shifted into the hooping plane and thus pass into the region of those elements of the stationary device 7 which clamp the beginning of the band so firmly over the band surface that an adequate band tension can be achieved in the pulling-back process. The arriving band portion is thereupon also clamped. The band is then cut off and the two band ends are thereupon joined to one another by welding.

The clamp lever 32 is cut off at 45° in plan view on the outer side of its angle shape. In consequence of the cut surface 34 thus formed, the band 13 can free itself from the clamp lever groove on being pulled back and laid against the package 9 when the clamp lever is pivoted through 45°. The pivoting is achieved with the aid of a pushrod 35 slidable in the transverse direction in the guide block 28 and cooperating with a rocking lever 37.

Figure 7:
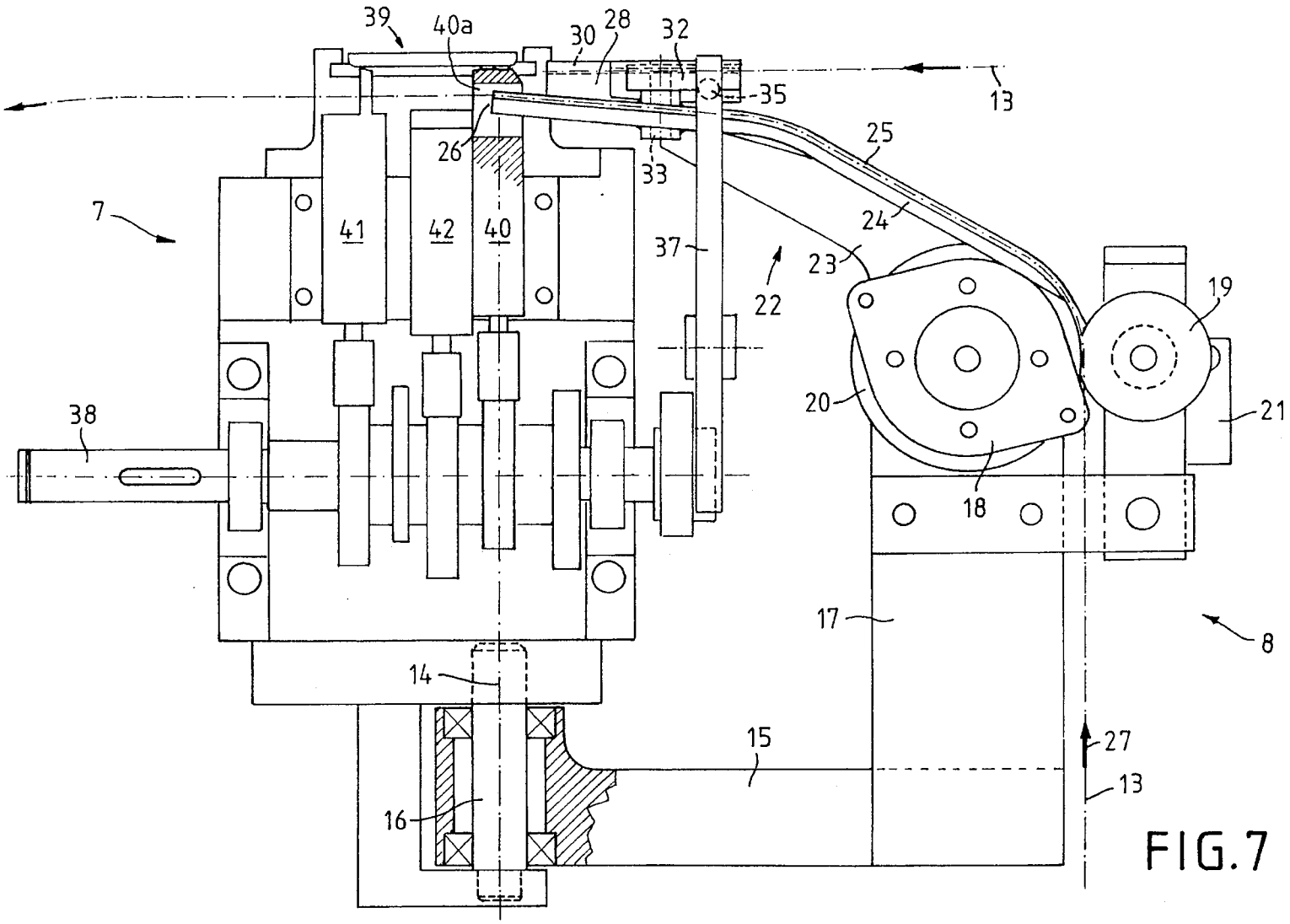
FIG. 7 shows a side view of the devices according to FIG. 6 in the direction of the arrow VII.

Seen in their context, the individual phases of a hooping process and the appertaining control processes proceed as follows. It should first be added in this connection that the device 7 contains a camshaft 38, which is shown in FIG. 7 and which, as is known per se, serves an essential control function. Amongst other things, the camshaft 38 controls a heating tongue 36, the rocking lever 37, two horizontal sliding members 39 lying one above the other and three vertical rams 40, 41 and 42.

Figure 6:
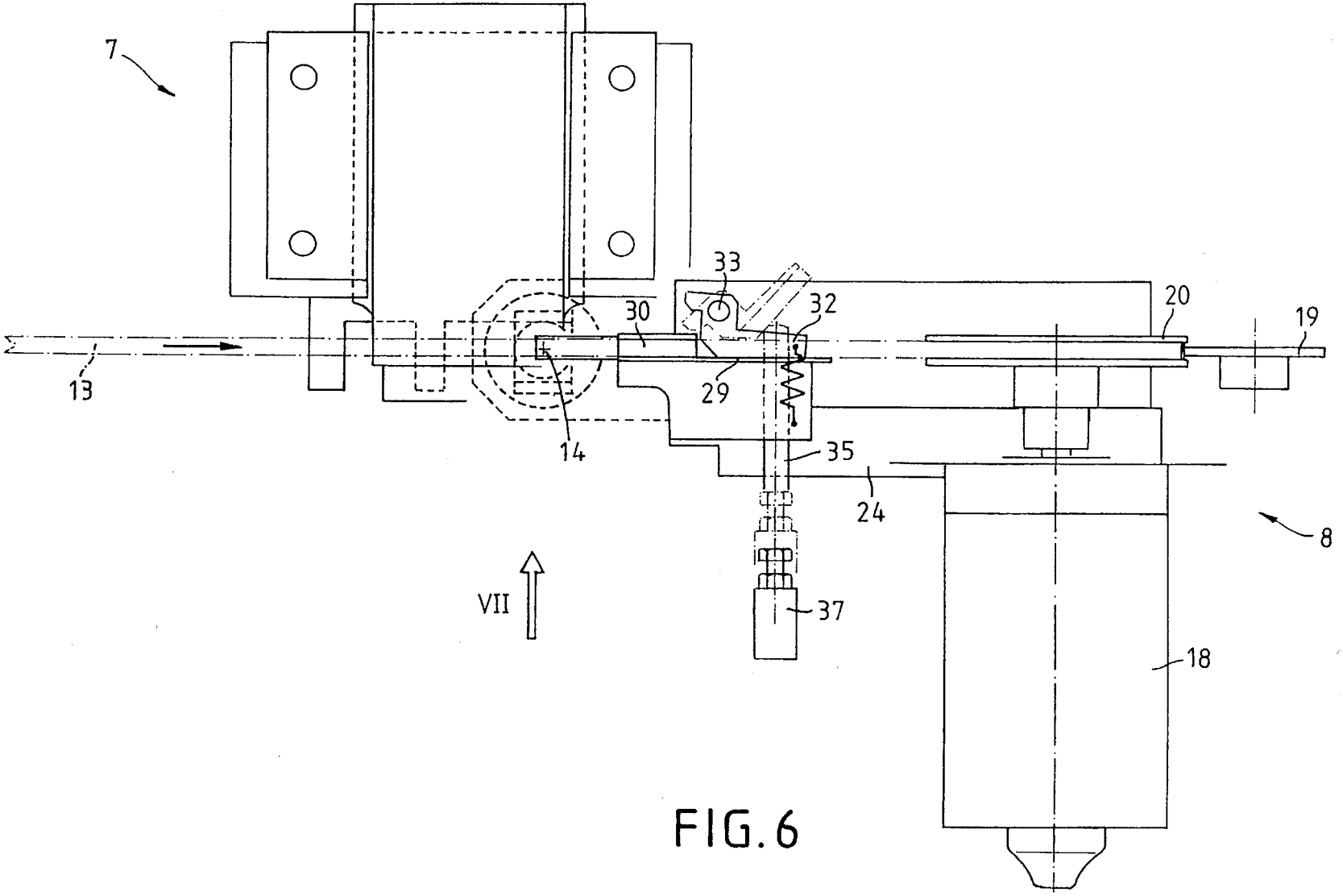
FIG. 6 shows the same devices as FIG. 5, in the pulling-back position.

On completion of a hooping process the above-described hooping apparatus is made ready for hooping, irrespective of whether a package 9 is or is not in the hooping position. For this purpose it is to be assumed that the pivotable device 8 is in the insertion position as shown in FIG. 5. By means of the electric motor 18 further band 13 is inserted. By way of the insertion channel 25 it passes into the band guide channel formed by the closed groove 10 and makes a complete circuit. Finally, the beginning of the band reaches the band switch. By means of the latter the electric motor 18 is stopped, the band guide frame is opened and the device 8 is pivoted into the pull-back position as shown in FIG. 6. On the commencement of the pivoting movement the beak of the clamp lever 32 is lifted off the stop pin 31, so that the spring can came into action and pull the clamp lever against the wall 29, thus holding the band fast on the pivotable device 8. Through the pivoting movement the band loop is twisted elastically because, apart from the pivoted band portions in the bottom middle region, the remaining, major part of the band loop is still situated between the opened band guide frame parts and is there held by brushes or similar elastic holding means. The machine is thus ready for hooping.

When a package 9 now comes into the hooping position, a trip switch is actuated and brings into operation the first phase of the cam control process. The end of the band is first clamped by means of the ram 40 in relation to the top sliding member 39. In this connection it should be observed that this ram 40 has beneath its pressure surface a transverse opening 40*a* through which the oncoming band 13 passes. The mouth of the insertion channel 25 partly projects into this opening. The clamp lever 32 is then released, that is to say brought into its 45° position, against the action of the spring, by means of the rocking lever 37 and the pushrod 35. The electric motor 18 then starts to turn in the opposite direction and the band is pulled back. The band loop is released from the band guide channel and flips into the hooping plane because of the initial stress produced by the device 8. When the band has finally been laid around the package 9, the motor 18 and the pressure roller 19 come to rest, this being detected by the proximity sensor 21.

The latter gives the starting signal for the second phase, that is to say the second rotation angle step of the camshaft 38.

In this phase, by means of the ram 41, the pulled back end bandloop portion is first clamped relative to the top sliding member 39. The ram 42 then cuts off the band by means of its right-hand edge. Immediately there-after the device 8 pivots back into the insertion position. During this time the heating tongue 36 runs in between the two band ends and heats them. After the heating tongue 36 has been pulled out again, the heated band ends are likewise clamped together by means of the ram 42 and thereby welded. Finally, all the rams and sliding members move back, so that the joined band loop is completely freed and the package 9 can be conveyed away.

The function cycle is thus terminated, whereupon the hooping apparatus is once again brought into the position of readiness for hooping.

It now depends on the rate of succession of the packages how long the hooping apparatus remains in each case in the position of readiness for hooping. The faster the rate at which the packages follow one another, the sooner the trip switch responds and, in the case of a high machine performance, the pulling-back of the band can then already start during the pivoting process or, in the extreme case, simultaneously therewith.

The most essential advantage of the hooping apparatus described consists in that, with the pivotable device 8, only a small part of the mechanical equipment has to be moved. Because of a purposefully light construction of this device, and for example also through the use of light metal, and because of the elimination of drives on the pivotable bow, the pivoting frequency and hence the performance of the hooping machine can be substantially increased.

We claim:

1. Apparatus for hooping a package, comprising:

a conveyor which conveys the package in a conveying direction into a hooping position;

a band positionable into an end position in which the band is applied against the package and tensioned and forms a band loop defining a hooping plane extending in the conveying direction;

a band guide channel which forms a substantially rectangular frame surrounding the package when the package is in the hooping position, said band guide channel receiving the band and forming the band into a loop shape, the rectangular frame defining a frame plane intersecting the hooping plane at an acute angle along an intersection line located at a right angle to the conveying direction; and a band binding head positioned adjacent to the rectangular frame, having a stationary device for holding fast and joining the ends of the band to form the band loop from the loop shape and for separating a portion of the band that forms the band loop from the oncoming band, and having a pivotable device, separate from and adjacent to said stationary device, for inserting the band into the band guide channel and for pulling back the band to place the band in the end position, and being mounted for pivoting about a pivot axis substantially coinciding with the intersection line, the pivotable device being located in the frame plane during the insertion of the band into the band guide channel and being pivotal into the hooping plane before or during the pulling-back of the band.

2. Hooping apparatus according to claim 1, wherein the pivotable device comprises an insertion channel having a mouth from which the oncoming band passes out lying in a region of the pivot axis, in that the band passing out of the insertion channel enters the band guide channel, passes through the band guide channel, and then assumes a position in which a starting portion of the band lies above a band portion situated in front of the mouth to form a doubled band portion, the doubled band portion being conjointly moved, by the pivoting of the pivotable device, out of an insertion position and into a pulling-back position.

3. Hooping apparatus according to claim 1, further comprising an intermediate clamp device arranged on the pivotable device for fastening a starting portion of the band to the pivotable device at least until the pivotable device has been pivoted into a pulling-back position.

4. Hooping apparatus according to claim 3, wherein the intermediate clamp device grips the edges of the band.

5. Hooping apparatus according to claim 4, wherein the intermediate clamp device comprises a clamp lever.

6. Hooping apparatus according to claim 2, further comprising a clamp device that grips the starting portion of the band on the longitudinal sides of the band in a position reached after the band has passed through the band guide channel, said clamp device having clamp elements mounted for pivoting about the pivot axis and being drivingly connected to the pivotable device.

7. Hooping apparatus according to claim 1, wherein the pivotable device comprises an insertion channel having a mouth from which the oncoming band passes out lying in a region of the pivot axis, the pivotable device further comprises a supporting structure forming a U-shaped bow with a first limb being a pivot arm pivotable about the pivot axis, and a second limb supporting a portion of the insertion channel on a side toward the mouth.

8. Hooping apparatus according to claim 1, wherein the pivotable device includes a feed roller means for conveying the band.

9. Hooping apparatus according to claim 6, wherein the pivotable device includes a feed roller means for conveying the band, being drivingly connected to a motor using a flexible shaft.

10. Hooping apparatus according to claim 8, further comprising a flexible band guide channel connecting the pivotable device to a band magazine which receives a length of band pulled back.

11. Hooping apparatus according to claim 1, further comprising a flexible band guide channel connecting the pivotable device to a stationary feed roller arrangement.

12. Hooping apparatus according to claim 11, wherein the stationary feed roller arrangement is a retensioning device.

13. Hooping apparatus according to claim 1, further comprising band guide elements each being located in a guide plane extending at a right angle to the hooping plane and intersecting the band guide frame, said band guide elements each having a guide edge which together form a straight slit therebetween, through which the hooping plane passes, a respective guide edge at an end of the slit being bent away in a curve at an obtuse angle towards a respective portion of the frame passing at a right angle through the guide plane.

14. Hooping apparatus according to claim 13, further comprising two rams each being movable at right angles to the guide plane for pressing the package against the guide plane after the package has reached the hooping position, said rams each having respective pressure plates which have additional guide edges which are congruent with the guide edges of the band guide elements.

15. An apparatus for hooping a package located in a hooping position using a band that is formed into a loop, and applied against the package and tensioned to define a hooping plane extending in a package conveying direction, said apparatus comprising:

a substantially rectangular frame comprising a band guide channel surrounding the package when the package is in the hooping position for receiving the band to form a loop shape, said frame defining a frame plane that intersects the hooping plane at an acute angle along an intersection line perpendicular to the conveying direction; and a binding head located adjacent to the package, and including:

stationary holding means for holding fast and joining the ends of the band to form the band loop from the loop shape, and for separating a portion of the band that forms the band loop from the oncoming band; and inserting and pull-back means separate from and adjacent to said stationary holding means and being mounted to pivot about a pivot axis substantially coinciding with the intersection line, for inserting the band into the band guide channel, and for pulling back the band to place the band in position against the package, said inserting and pull-back means being located in the frame plane when the band is inserted into said band guide channel, and being pivotable about the pivot axis into the hooping plane before or during a pulling back of the band.

16. The apparatus defined in claim 15, wherein the hooping plane extends essentially perpendicularly to a conveying plane.

17. Hooping apparatus according to claim 1, wherein the hooping plane extends essentially perpendicularly to the conveyor.

18. Hooping apparatus according to claim 17, wherein said rectangular frame extends essentially perpendicularly to said conveyor.

* * * * *